US005406023A

United States Patent [19]

Nagahama

[11] Patent Number: 5,406,023

[45] Date of Patent: Apr. 11, 1995

[54] ELECTRONIC MUSICAL INSTRUMENT USING SIMPLIFIED REGISTRATION SELECTION

[75] Inventor: Yasuo Nagahama, Hamamatsu, Japan

[73] Assignee: Yamaha Corporation, Hamamatsu, Japan

[21] Appl. No.: 22,079

[22] Filed: Feb. 24, 1993

[30] Foreign Application Priority Data

Feb. 25, 1992 [JP] Japan ..... 4-038162

[51] Int. Cl.[6] ..... G10H 1/06; G10H 1/40; G10H 1/46

[52] U.S. Cl. ..... 84/622; 84/630; 84/633; 84/636; 84/DIG. 12

[58] Field of Search ..... 84/609–614, 84/622–638, 649–652, 659–669, 692–717, DIG. 12

[56] References Cited

U.S. PATENT DOCUMENTS 4,356,751 11/1982 Niinomi et al. ..... 84/701
5,179,240 1/1993 Mizuno et al. ..... 84/613

FOREIGN PATENT DOCUMENTS 55-152594 11/1980 Japan .
6111758 11/1980 Japan .
55-159496 12/1980 Japan .
61-11758 4/1986 Japan .
62-29795 6/1987 Japan .
62-175797 8/1987 Japan .
62-175798 8/1987 Japan .

*Primary Examiner*—Stanley J. Witkowski
*Attorney, Agent, or Firm*—Spensley Horn Jubas & Lubitz

[57] ABSTRACT

An electronic musical instrument for realizing an easy selection of registration from a variety of registrations. First, a number from "1" to "10" is selected in an upper keyboard timbre select switch group, the numbers corresponding to various timbres, such as piano, organ, harpsichord, guitar, or the like respectively. Similarly, another number from "1" to "10" is selected in a rhythm selecting switch group, the numbers corresponding varies to rhythms, such as jazz, pops, mood music, children's songs, classical, or the like. According to this, a preferable registration group with respect to the music can be easily selected from a great number (i.e., $10\times10=100$) of registration groups.

18 Claims, 7 Drawing Sheets

| UPPER KEYBOARD TIMBRE NUMBER "UN" / RHYTHM PATTERN NUMBER "RN" | 1 | 2 | 3 | ..... | 10 |
|---|---|---|---|---|---|
| 1 | REGISTRATION GROUP 11 | REGISTRATION GROUP 12 | REGISTRATION GROUP 13 | ..... | REGISTRATION GROUP 1A |
| 2 | REGISTRATION GROUP 21 | REGISTRATION GROUP 22 | REGISTRATION GROUP 23 | ..... | REGISTRATION GROUP 2A |
| 3 | REGISTRATION GROUP 31 | REGISTRATION GROUP 32 | REGISTRATION GROUP 33 | ..... | REGISTRATION GROUP 3A |
| ⋮ | ⋮ | ⋮ | ⋮ | ⋮ | ⋮ |
| 10 | REGISTRATION GROUP A1 | REGISTRATION GROUP A2 | REGISTRATION GROUP A3 | ..... | REGISTRATION GROUP AA |

FIG.6

| REGISTRATION NUMBER | 1 | 2 | 3 | ····· | 10 |
|---|---|---|---|---|---|
| UPPER KEYBOARD TIMBRE NUMBER | 1 | 1 | 1 | | 1 |
| BRILLIANCE | 6 | 6 | 7 | ····· | 6 |
| VOLUME | 5 | 5 | 6 | | 5 |
| LOWER KEYBOARD TIMBRE NUMBER | 3 | 3 | 4 | | 6 |
| BRILLIANCE | 3 | 2 | 4 | ····· | 3 |
| VOLUME | 4 | 4 | 4 | | 4 |
| PEDAL KEYBOARD TIMBRE NUMBER | 2 | 3 | 3 | | 2 |
| BRILLIANCE | 2 | 2 | 2 | ····· | 2 |
| VOLUME | 4 | 4 | 5 | | 4 |
| RHYTHM PATTERN NUMBER | 1 | 1 | 1 | | 1 |
| BRILLIANCE | 4 | 4 | 3 | ····· | 3 |
| VOLUME | 5 | 5 | 5 | | 5 |
| RHYTHM VARIATION NUMBER | 11 | 12 | 13 | ····· | 1A |
| TEMPO | 110 | 110 | 110 | ····· | 110 |
| REVERBERATION | 4 | 4 | 5 | ····· | 4 |
| ⋮ | ⋮ | ⋮ | ⋮ | ····· | ⋮ |

FIG.7 CONTENTS OF REGISTRATION GROUP 11

ELECTRONIC MUSICAL INSTRUMENT USING SIMPLIFIED REGISTRATION SELECTION

BACKGROUND OF THE INVENTION

1. Field of the Invention

The present invention relates to an electronic musical instrument for generating a variety of musical tones by simple operations.

2. Prior Art

Conventionally, large scale electronic musical instruments such as electronic organs require various panel settings prior to the performance so as to designate the timbre, etc., of the musical tones. For example, when the electronic organ contains an upper keyboard, a lower keyboard and a pedal keyboard, "registration" should be made for timbre setting, rhythm selection, tempo setting, and sound effect selection, etc., corresponding to the three keyboards, respectively.

Such a registration setting is troublesome, especially for the beginners, and requires considerable time to determine the most preferable timbre with respect to the music to be performed. Consequently, an electronic musical instrument was proposed wherein the musical genre to be performed (e.g., jazz style, pops style) is selectable by the performer, and the registration setting of timbre, etc., can be automatically executed (Japanese Patent Publication No. Sho 62-29795).

Furthermore, another instrument was proposed wherein the rhythm is selectable by the performer, and the registration setting with respect to the timbre, etc., could be automatically executed (Japanese Utility Patent Publication No. Sho 61-11758).

The techniques described above actualize the easy setting of registrations; however, the number of registrations to be selected should be small, and therefore, it is difficult to utilize a variety of timbre setting capabilities essentially provided with the electronic musical instrument. In other words, according to the above technique, the same registration will be selected when the same "genre" or "rhythm" are set; however, there are several cases in which the selected registration is not appropriate for the music to be performed.

SUMMARY OF THE INVENTION

It is accordingly an object of the present invention to provide an electronic musical instrument wherein a variety of timbres can be selected by easy operations.

In a first aspect of the present invention, there is provided an electronic musical instrument comprising:

a memory means for storing a plurality of tone control data which can be determined by a first parameter and a second parameter;

a selecting means for determining the first parameter and the second parameter;

a readout means for reading out a tone control data group which indicates a plurality of characteristics of a musical tone, from the memory means, in accordance with the first parameter and the second parameter which are determined by the timbre selecting means; and a tone control means for controlling the musical tone in response to the tone control data group.

When the first and second parameters are selected via the timbre selecting means, the determined tone control data group is read out from the memory means. Therefore, the maximum number of groups is the multiplication product of the numbers of the first and second parameters. Consequently, even if the numbers of the first and second parameters are small, the number of the selectable tone control data groups can be comparatively large.

BRIEF DESCRIPTION OF THE DRAWINGS

FIGS. 6 and 7 are tables showing the operating condition of the electronic musical instrument.

DESCRIPTION OF THE PREFERRED EMBODIMENT

A. Composition of the Embodiment

A-1. Overall Composition of the Embodiment

Further objects and advantages of the present invention will be apparent from the following description, reference being made to the accompanying drawings wherein a preferred embodiment of the present invention is clearly shown.

Figure 1:
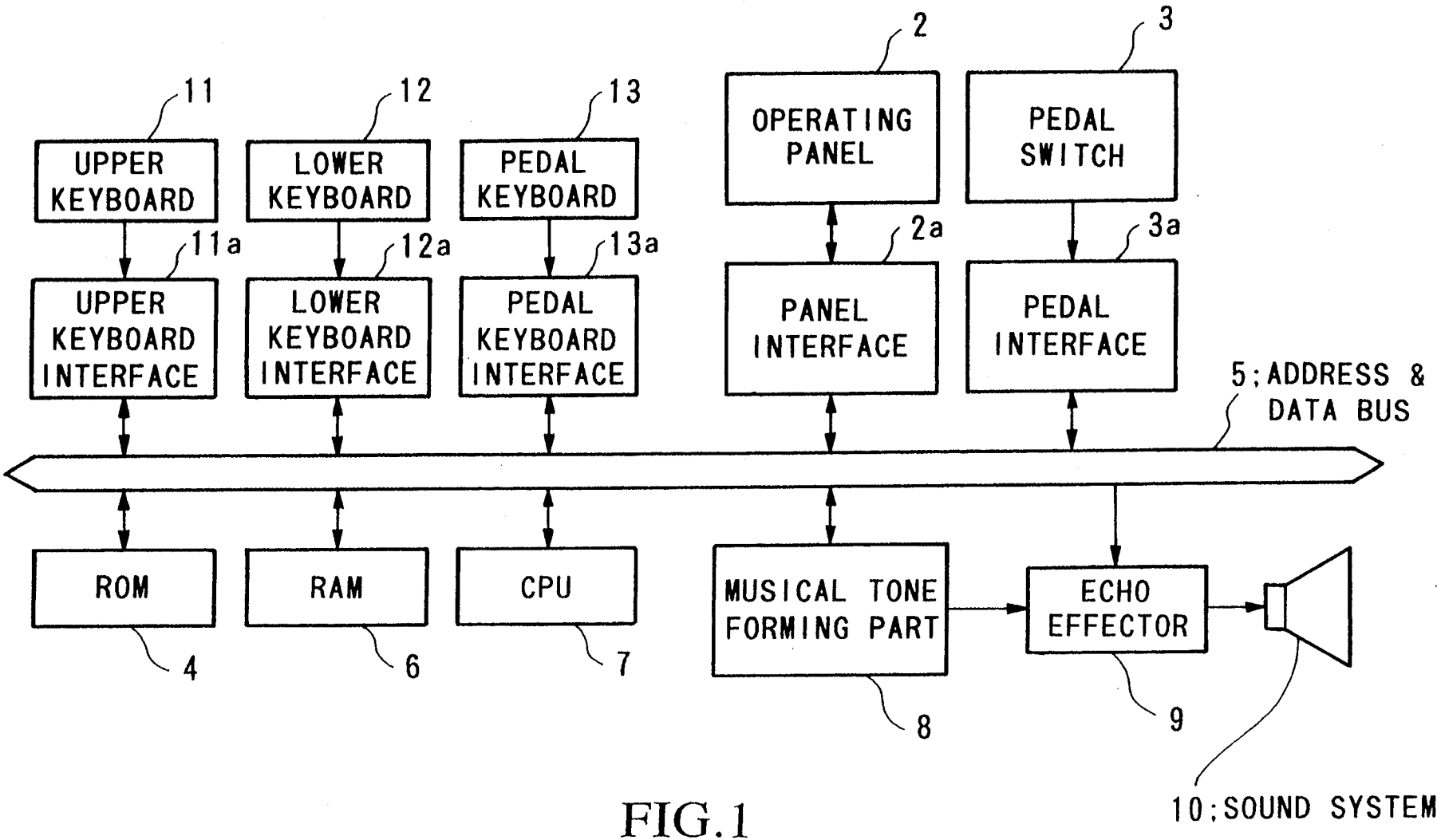
FIG. 1 is a block diagram showing an electronic configuration of an electronic musical instrument according to a preferred embodiment of the present invention.

FIG. 1 is a block diagram showing the electric configuration of the electronic musical instrument according to the preferred embodiment of the present invention.

In FIG. 1, an upper keyboard 11, a lower keyboard 12, and a pedal keyboard 13 are shown, the keyboards are provided with a plurality of keys to be operated by the performer. The operation data with respect to the keys are sequentially generated via interfaces 11*a*, 12*a*, and 13*a*, and a bus 5, the interfaces corresponding to the keyboards, respectively.

Figure 5:
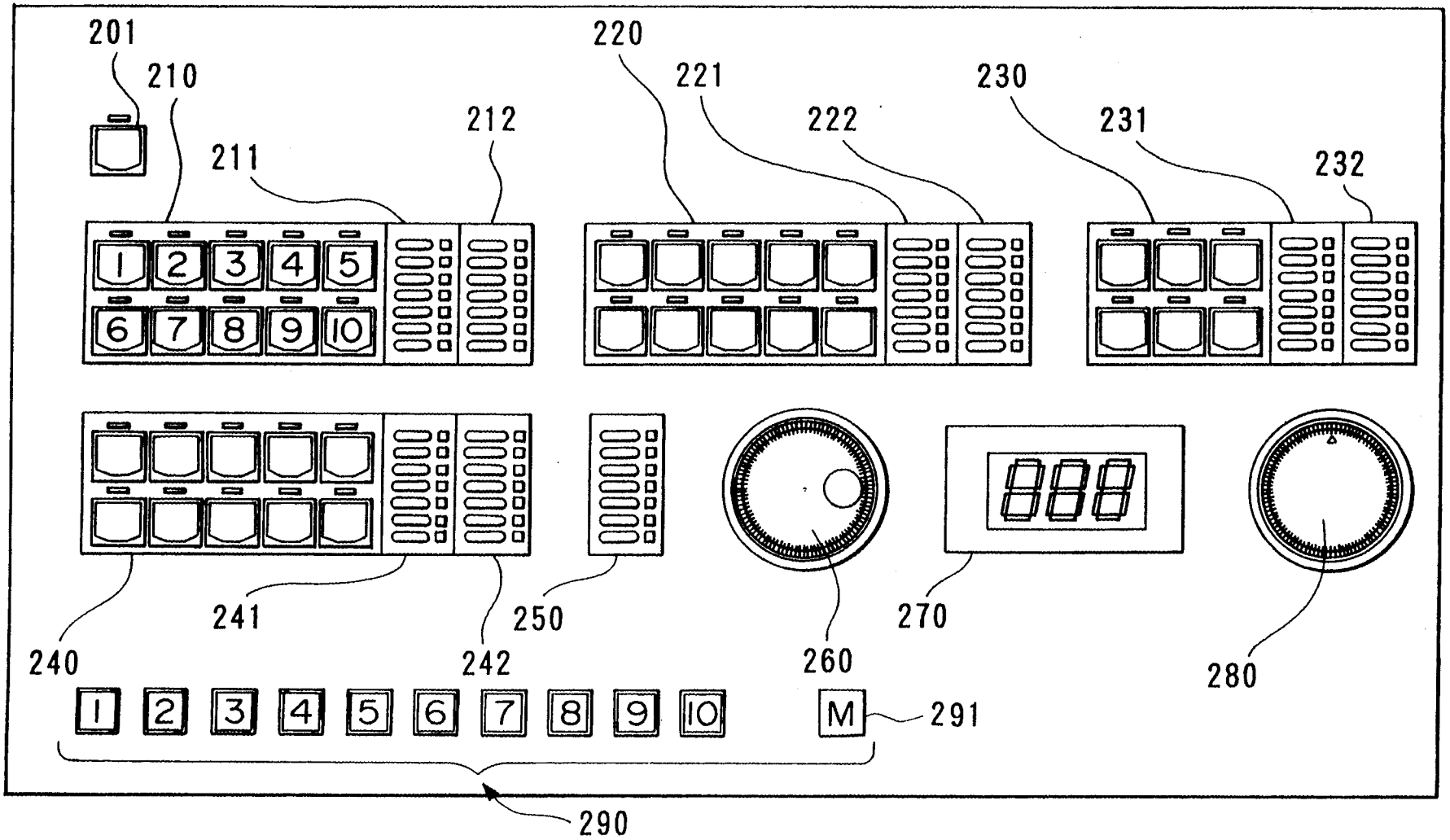
FIG. 5 is a plan view of an operating panel.

An operating panel 2 having various switches and displays as shown in FIG. 5 is provided for setting the timbre and the tempo, for selecting the rhythm and sound effects, and for various other settings of the registrations with respect to the keyboards 11, 12 and 13, respectively. The details of the registration settings will be described later. The operating data with respect to the operating panel 2 is generated via an interface circuit 2*a* and the bus 5. The numeral 3 designates a pedal having pedal switches for generating pedal operation data via a pedal interface 3*a* and the bus 5. This pedal is provided for volume control in a manner similar to the conventional electronic musical instruments. The pedal switches (left and right pedal switches) are fitted at both sides of the pedal and protrude upward from the pedal. Consequently, a performer can individually execute the ON/OFF operation of the switches by using the foot.

The numeral 7 designates a CPU (Central Processing Unit) for controlling the various circuits in accordance with control programs stored in a ROM (Read Only Memory) 4. More specifically, the CPU 7 creates performance data in accordance with the operating data supplied from the keyboards 11, 12, and 13, the operating panel 2, and the pedal switch 3, etc., and generates the performance data via the bus 5. The numeral 8 designates a musical tone forming part for synthesizing the musical tone signal in accordance with the performance data received from the CPU 7, and for supplying the musical tone signal to an echo effector 9. Then, the musical tone signal supplied to the echo effector 9 is echoed in accordance with the data received from the CPU 7, and is then generated by a sound system 10 as a musical tone.

A-2. Composition of the Operating Panel 2

Detailed description of the operating panel 2 will be made herein below with reference to FIG. 5.

(i) Beginners' mode switch 201

In FIG. 5, the numeral 201 designates a beginners' mode switch for altering the operation mode consisting of a "beginners' mode" and a "standard mode", each time the switch is depressed. In the beginners' mode, the performer is able to set all the registrations, automatically, when the performer operates an upper keyboard timbre select switch group 210, a rhythm selecting switch group 240, and a pedal switch 3. The details of the automatic registration setting will be described later.

In the standard mode, the performer has to operate not only the above-described switch groups, but other various operating members, manually, in order to set the registrations. Adjoining the beginners' mode switch 201, a LED is provided to be illuminated when the beginners' mode is selected.

(ii) Timbre selecting switch groups 210, 220 & 230 for upper, lower and pedal keyboards The upper keyboard timbre select switch group 210 mainly consists of ten switches having the numbers of "1" to "10", and ten LEDs adjoining the switches, respectively. These switches correspond to various timbres, respectively. For example, the timbres may be those of piano, organ, harpsichord, guitar, oboe, trumpet, etc. When any of the switches is depressed, the timbre corresponding to the switch is determined as the timbre of the upper keyboard 11, and the LED adjoining the switch is illuminated.

Similarly, the timbre select switch groups 220 and 230 for the lower and pedal keyboards are provided in order to select the timbres corresponding to the lower and pedal keyboards, respectively.

(iii) Rhythm selecting switch group 240

The rhythm selecting switch group 240 consists primarily of ten switches having the numbers of "1" to "10", and ten LEDs adjoining the switches, respectively. These switches are in correspondence of various rhythms, for example, jazz, pops, mood music, children's songs, and classical, etc. When any of the switches is depressed, the rhythm corresponding to the switch is determined as the rhythm corresponding to the music to be performed, and the LED adjoining the switch is illuminated.

(iv) Brilliance setting switch groups 211, 221, 231 and 241

Corresponding to the keyboards 11, 12 and 13, brilliance setting switch groups 211, 221 and 231 are provided for setting the "brilliance" of tones with respect to the keyboards 11, 12 and 13, respectively. The brilliance setting switch groups consists primarily of seven switches and seven LEDs adjoining the switches in order to determine the brilliance values, the values being from "1" to "7", with respect to the corresponding keyboards. More specifically, the higher the brilliance value is set, the more brilliant the timbre will be set; whereas the lower the brilliance value is set, the mellower the timbre will be set. Similarly, a brilliance setting switch group 241 is provided for determining the brilliance of the rhythm which is selected by the rhythm selecting switch group 240.

(v) Volume setting switch groups 212, 222, 232 & 242, and master volume 280

Corresponding to the keyboards 11, 12 and 13, volume setting switch groups 212, 222 and 232 are provided for setting the volumes of tones with respect to the corresponding keyboards, respectively. In a manner similar to that of the brilliance setting switch group 211, etc., the volume setting switch groups consist primarily of seven switches and seven LEDs, respectively, in order to set and indicate the volume of the corresponding key with values from "1" to "7". Similarly, a volume setting switch group 242 is provided for setting the volume with respect to the rhythm selected by the rhythm selecting switch group 240. Furthermore, a master volume controller 280 is provided for controlling the volume of the entire musical tone.

(vi) Reverberation setting switch group 250

In a manner similar to that of the brilliance setting switch group 211, etc., a reverberation setting switch group 250, consisting primarily of seven switches and seven LEDs, is provided for determining a reverberation value, the value being selected from "1" to "7".

(vii) Tempo setting member 260 and tempo indicator 270

The numeral 260 designates a tempo setting member for adjusting the tempo of a rhythm sound such that the tempo becomes faster according to clockwise turning of the member. The tempo, so determined, is indicated by a tempo indicator 270.

(viii) Registration memory button group 290

The numeral 290 designates a registration memory button group for storing and reproducing the registrations, the group consisting primarily of ten number designation keys numbered from "1" to "10", and a memory designation button 291. More specifically, when any of the number designation keys from "1" to "10" and the memory designation button 291 are depressed simultaneously, the operating condition of the panel 2 is stored in the RAM 6 and is numbered by the designated number, from "1" to "10". When any of the number designation keys from "1" to "10" is depressed without the depression of the memory designation button 291, the operating condition corresponding to the designated number is read out from RAM 6 and the operating panel 2 is so reset.

A-3. Composition of ROM 4

ROM 4 stores not only the control programs, but also various types of data and tables which are utilized in other processes. In particular, ROM 4 stores a plurality of registrations which are determined in accordance with the combination of an upper keyboard timbre number UN, a rhythm number RN, and the registration number selected by the registration memory button group 290. The details thereof will be described with reference being made to FIGS. 6 and 7.

FIG. 6 shows the registration group, the members of which are determined in accordance with the upper keyboard timbre number UN selected by the upper keyboard timbre select switch group 210, the rhythm number RN selected by the rhythm selecting switch group 240. Because both upper keyboard timbre number UN and the rhythm number RN vary in the range from "1" to "10", one hundred registration groups can be selected in response to the switch groups 210 and 240.

However, when the registration group is merely selected by switch groups 210 and 240, a specific registration is not yet determined. Any registration number from "1" to "10" should be finally selected. The selection is, for example, executed by the registration memory button group 290. FIG. 7 shows an example of the contents of the registration group which is selected when the upper keyboard timbre number UN is "1" and the rhythm number RN is "1". As shown in FIG. 7, any the registration having the number form "1" to "10" contains timbre numbers, brilliance values and volumes of the upper, lower, and pedal keyboards; a rhythm pattern number, a brilliance value, and a volume with respect to the automatic rhythm; a rhythm variation pattern number for designating the varied rhythm pattern of the automatic rhythm; and other various data. It is understood that the registrations corresponding to the registration numbers from "1" to "10" have different contents, respectively, even though the registrations are contained in the same group. However, because those registrations are in correspondence with the condition wherein the upper keyboard timbre number UN is "1", the upper keyboard timbre number UN of the registrations should be "1".

B. Operation of the Embodiment

B-1. Overall operation of the Embodiment

Figure 2:
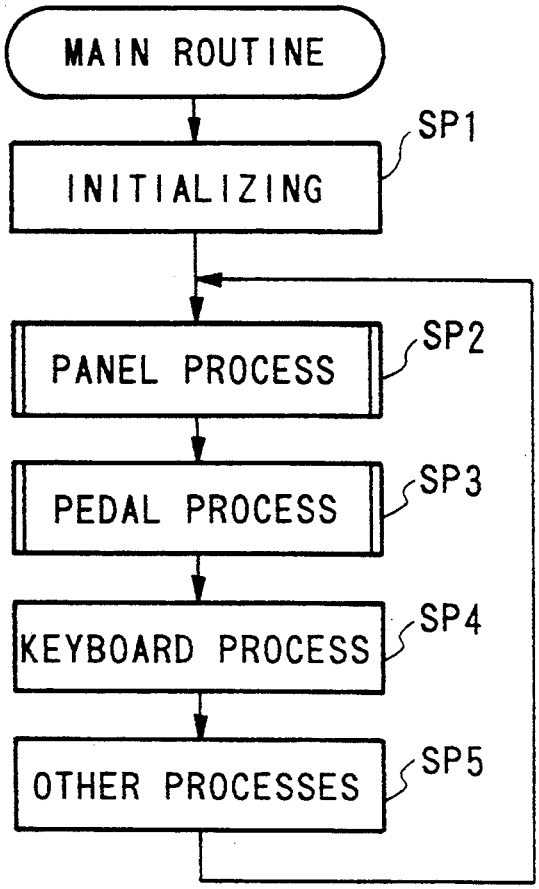
FIGS. 2 to 4 are flow charts of the control programs of the electronic musical instrument.

Next, the operation of the embodiment will be described with reference being made to FIGS. 2 to 4, and 6 and 7. First, when the electronic musical instrument of the embodiment is turned on, the main routine shown in FIG. 2 is executed. In FIG. 2, when the process starts at step SP1, various flags and variables, etc., are initialized.

Then, the process moves to step SP2 wherein a judgement is rendered as to whether or not any event of the various members has occurred in the operating panel 2. If any event has occurred, the registration corresponding to the event is recalled. Then, process moves to step SP3 wherein judgement is rendered as to whether or not any event has occurred with respect to the pedal switch. If any event has occurred, the registration corresponding to the event is recalled.

The process then moves to step SP4 wherein judgement is rendered as to whether or not any event in the keyboards 11, 12 and 13 has occurred. If any event has occurred, the performance data corresponding to the event is supplied to the musical tone forming part 8, and the musical tone is generated via the echo effector 9 and the sound system 10. Processing then moves to step SP5 wherein various other operations are executed, and the process returns to step SP2.

As described above, processes with respect to steps SP2 to SP5 are executed, repeatedly, such that the registrations are altered via the steps SP2 and SP3, and the musical tone signal is synthesized via the steps SP4 and SP5. The steps SP4 and SP5, described above, are similar to those in the conventional electronic musical instruments. This embodiment is characterized, in particular, in the steps SP2 and 3, the details of which will be described below, reference being made to FIGS. 3 and 4.

B-2. Details of the panel process (step SP2)

Figure 3A:
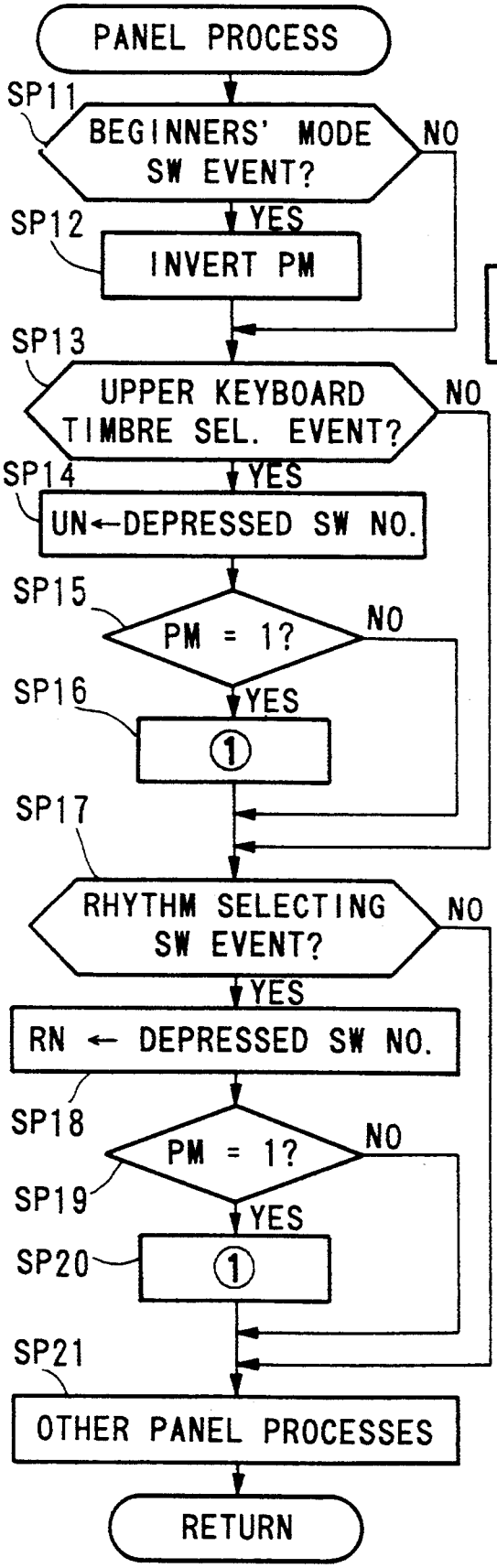
Figure 3B:
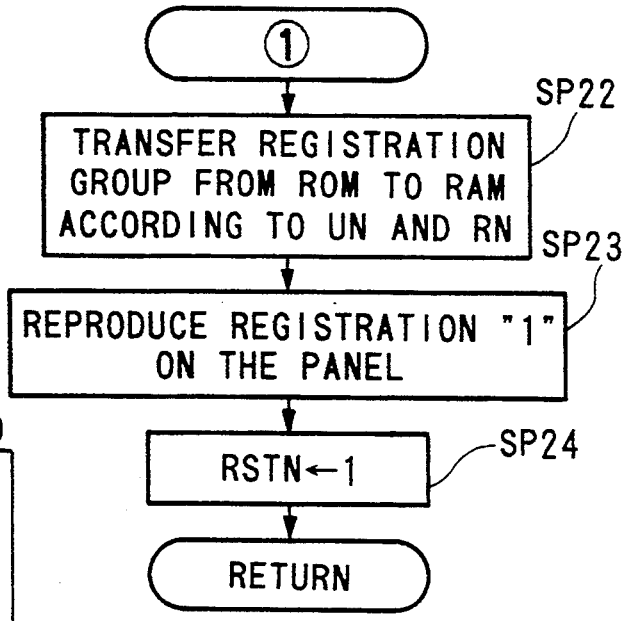

In the step SP2, the panel process subroutine shown in FIG. 3(*a*) is called up. In FIG. 3(*a*), the subroutine starts at step SP11 wherein judgement is rendered as to whether or not any event of the beginners' mode switch 201 has occurred. If the judgement is "YES", the process moves to step SP13 via the step SP12, whereas the process moves to step SP13 directly if the judgement is "NO".

In the step SP13, judgement is rendered as to whether or not any event of the upper keyboard timbre select switch group 210 has occurred. If the judgement is "YES", the process moves to step SP17 via the steps SP14 to 16, whereas the process directly moves to step SP17 if the judgement is "NO". Similarly, in the step SP17, judgement is rendered as to whether or not any event of the switches in the rhythm selecting switch group 240 has occurred. If the judgement is "YES", the process moves to step SP21 via the steps SP18 to 20, whereas the process moves directly to step SP21 if the judgement is "NO". As described above, operations in this subroutine are executed corresponding to the switch groups in which any event has occurred. The details of the operations with respect to the various events will be described below.

(i) Operation in the case where the event of the beginners' mode switch 201 has occurred When the process moves to step SP12 in response to the event of the beginners' mode switch 201, the contents of a flag PM is inverted. The flag PM, indicating the operation mode, will be determined to be "1" and "0". The value "1" designates the "beginners' mode", and the value "0" designates the "standard mode". Consequently, the operation mode is changed any time the event of the beginners' mode switch 201 has occurred. The operation mode flag PM is determined to be "0" (i.e., standard mode) when the initializing (see step SP1 in FIG. 2) is executed.

(ii) Operation in the case where the event of the upper keyboard timbre select switch group 210 has occurred When the process moves to step SP14 in response to the event of the upper keyboard timbre select switch group 210, any of the switch numbers "1" to "10", the number corresponding to the switch in the event, is stored in a variable UN (hereinafter, referred to as "upper keyboard timbre number UN"). Then, the process moves to step SP15 in which the judgement is rendered as to whether or not the operation mode flag PM is "1". If the current mode is the "beginners' mode" and consequently, the operation mode flag PM is "1", the judgement will be "YES", and the process moves to step SP16. In the step SP16, the subroutine shown in FIG. 3(*b*) is called.

When the operation with respect to the subroutine in FIG. 3(*b*) starts, the process moves to step SP22 in which a registration group, the group in correspondence with the upper keyboard timbre number UN and the rhythm number RN, is read out from the ROM 4 and stored in the RAM 6 (see FIG. 6). Incidentally, the rhythm number RN will be determined to be "1" in the initialization, while the number RN can be changed in step SP18, the details of which will be described later.

Then, the process moves to step SP23 in which the various conditions are recalled into the operating panel 2 in accordance with the registration having the number "1" (see FIG. 7), the registration is a member of the registration group previously transferred to the RAM 6. More specifically, according to the specific timbre numbers with respect to the keyboards, respectively, LEDs provided corresponding to the specific timbre numbers are illuminated in the timbre select switch groups 210, 220, and 230. Furthermore, corresponding to the brilliance values with respect to the keyboards, one LED is illuminated in each brilliance setting switch group 211, 221, 231, and 241. Similarly, corresponding to the volumes with respect to the keyboards, one LED is illuminated in each volume setting switch group 212, 222, 232 and 242.

Then, the process moves to step SP24 wherein a variable RSTN, indicating the current registration number, is set to "1". Hereinafter, the variable RSTN is referred to as "registration number RSTN". Then, the process returns to the panel process subroutine (FIG. 3(*a*)).

(iii) Operation in the case where the event of the rhythm selecting switch group 240 has occurred When the process moves to step SP18 in response to an event in the rhythm selecting switch group 240, any of the switch numbers "1" to "10", the number corresponding to the switch in the event, is stored in a variable RN (hereinafter, referred to as "rhythm number RN"). Then, the process moves to step SP19 in which the judgement is rendered as to whether or not the operation mode flag PM is "1". If the judgement is "YES", the process moves to step SP20 wherein the subroutine shown in FIG. 3(*b*) is called up.

In the subroutine shown in FIG. 3(*b*), operations are executed in a manner similar to that of the above-described step SP16. More specifically, in step SP22, a registration group is read out from the ROM 4, the registration group is in correspondence with the upper keyboard timbre number UN which is previously determined in the initialization (see step SP1) or the process in step SP14, and with the recently determined rhythm number RN. Then, the specific registration having the number "1" is recalled Into the operating panel 2 (see step SP23), and the registration number RSTN is determined to be "1" (step SP24).

(iv) Other operations

When the operations with respect to the steps SP11 to 24 are terminated, the process moves to step SP21 in which other various panel operations are executed. For example, registration memory button group 290 may be operated in order to change the number RSTN of the registration to be recalled into the operating panel 2, other devices are operated in order to correct the registration, and start or stop the automatic rhythm in response to the commands from the performer. When the various operations are terminated, the process moves to the main routine (FIG. 2).

As described above, when the beginners' mode switch 201 is operated so as to set the operation mode to be the "beginners' mode", the performer is only required to operate the upper keyboard timbre select switch group 210 and the rhythm selecting switch group 240 which are consist primarily of ten switches, respectively, and the performer can easily select the most suitable registration group corresponding to the music from a great number of registration groups.

B-3. The details of the pedal process (step SP3)

Figure 4:
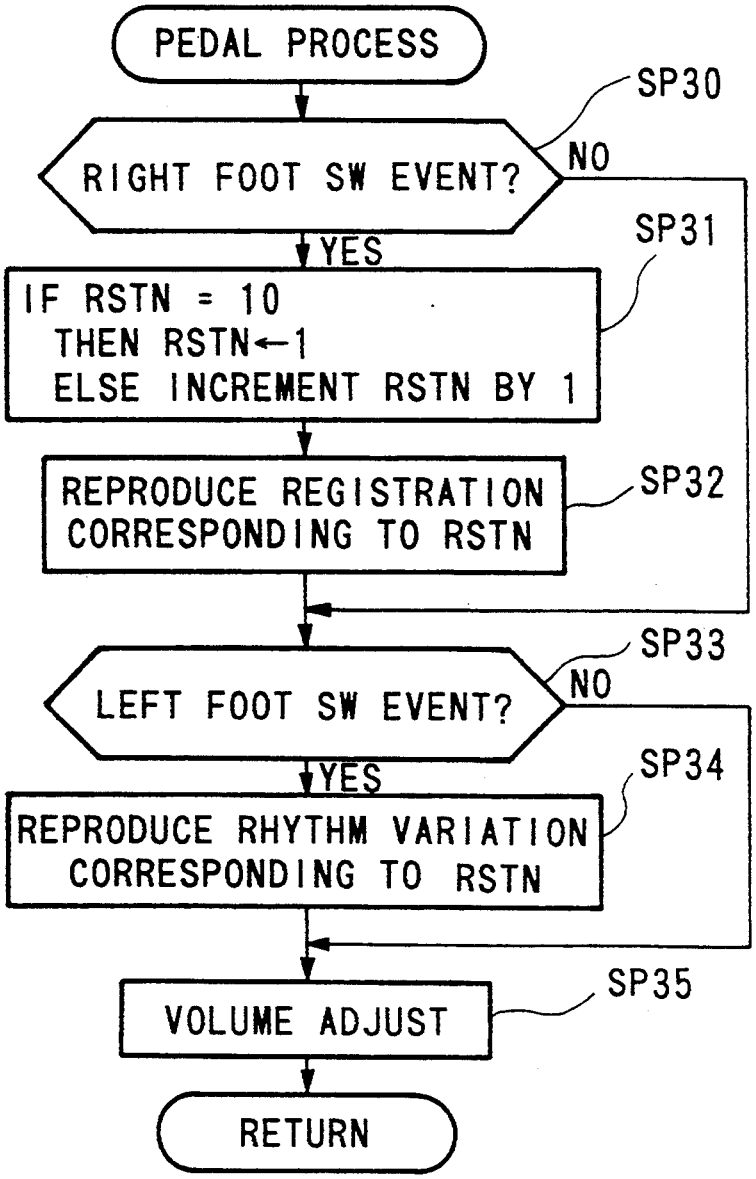

In the step SP3, the pedal process subroutine shown in FIG. 4 is called up. In FIG. 4, the subroutine starts at step SP30 wherein judgement is rendered as to whether or not any event of the right foot switch has occurred. If the judgement is "YES", the process moves to step SP31, whereas the process moves to step SP33 if the judgement is "NO".

In the step SP31, the registration number RSTN is incremented by one. Then, the process moves to step SP32 in which the registration corresponding to the number RSTN is recalled into the operating panel 2. Consequently, if the required registrations from the beginning to the ending of the music are sequentially recorded corresponding to the registration numbers from "1" to "10", the performer can sequentially change the current registration corresponding to the progress of the music to be performed simply by means of the operation of the right foot switch. When the step SP32 is terminated, the process moves on to step SP33.

In the step SP33, judgement is rendered as to whether or not any event of the left foot switch has occurred. If the judgement is "YES", the process moves to step SP34, whereas the process moves to step SP35 if the judgement is "NO".

In the step SP34, an automatic rhythm having the rhythm variation pattern number of the registration corresponding to the number RSTN, is played back for a prespecified period. Consequently, if the left foot switch is operated during the playing back of automatic rhythm of the rhythm pattern number with respect to the designated registration, the automatic rhythm having the rhythm variation pattern number of the designated registration is played back for the prespecified period, and then the original automatic rhythm is resumed. When the step SP34 is terminated, the process moves to step SP35.

In the step SP35, the volume of the generated musical tone is adjusted corresponding to the depth of depression of the pedal, and the process returns to the main routine.

This invention may be practiced or embodied in still other ways without departing from the spirit or essential character thereof. For example, in the present embodiment, the specific registration is determined in accordance with two "parameters", namely, the timbre of the upper keyboard and the rhythm pattern; however, any other parameters can be utilized for the determination. Three or more parameter can be utilized for the determination. Furthermore, the "registration" may include the conditions and data which cannot be determined manually by the operating panel 2. For example, according to the above embodiment, the "rhythm variation" is not able to be determined by the panel.

Therefore, the preferred embodiments described herein are illustrative and not restrictive, the scope of the invention being indicated by the appended claims, and all variations which fall within the scope of the claims are intended to be embraced therein.

What is claimed is:

1. An electronic musical instrument comprising:

first memory means for storing a plurality of tone control data groups, each of which is identified by a pair of parameters including a first parameter and a second parameter, and each group contains a plurality of tone control data subgroups that each include musical tone data;

first selection means for setting the first and second parameters;

designating means for designating one of the plurality of tone control data groups on the basis of the first and second parameters that are set by the first selection means;

second selection means for selecting one tone control data subgroup from the one of the plurality of tone control data groups which is designated by the designating means; and tone control means for controlling a musical tone by the musical tone control data contained in the one tone control data subgroup selected by the second selection means.

2. An electronic musical instrument according to claim 1, wherein the first parameter represents a timbre and the second parameter represents a rhythm.

3. An electronic musical instrument according to claim 1, wherein the musical tone control data includes a tone volume, a brilliance, a tempo and a reverberation value.

4. An electronic musical instrument according to claim 1, further including an upper keyboard and a lower keyboard, and wherein the first parameter represents the timbre of the upper keyboard.

5. An electronic musical instrument comprising:

an operation panel having a plurality of manually operable members;

first memory means for storing a plurality of panel setting information groups, each of which is identified by a pair of parameters including a first parameter and a second parameter, each group containing a plurality of panel setting information subgroups;

first selection means for setting the first and second parameters;

read-out means for reading out one of the plurality of panel setting information groups from the first memory means on the basis of the first and second parameters that are set by the first selection means;

second memory means for storing the panel setting information group that is read from the first memory means by the read-out means;

second selection means for selecting one of the plurality panel setting information subgroups that is included in the panel setting information group stored in the second memory means, wherein the panel setting information subgroup indicates setting states of the plurality of manually operable members; and tone control means for controlling a musical tone in response to the setting states of the plurality of manually operable members indicated by the one panel setting information subgroup selected by the second selection means.

6. An electronic musical instrument according to claim 5, wherein the first parameter represents a tone color and the second parameter represents a rhythm.

7. An electronic musical instrument according to claim 5, wherein the panel setting information subgroup that indicates the setting states of the plurality manually operable members, includes a tone volume, a brilliance, a tempo and a reverberation value.

8. An electronic musical instrument according to claim 5, wherein a status of the operation panel is stored in the second memory means.

9. An electronic musical instrument according to claim 5, further including a pedal, wherein the second selection means is activated by the pedal, so that every time the pedal is operated, each of the plurality of panel setting information subgroups included in the panel setting information group stored in the second memory means are selected in turn.

10. A method of selecting musical tone control data for an electronic musical instrument, the method comprising the steps of:

storing a plurality of tone control data groups in which each group contains a plurality of tone control data subgroups that each include musical tone control data;

identifying each tone control data group by a pair of parameters including a first parameter and a second parameter;

setting the first and second parameters;

designating one of the plurality of tone control data groups on the basis of the set first and second parameters;

selecting one tone control data subgroup from the designated one of the plurality of tone control data groups; and controlling a musical tone by the musical tone control data contained in the selected one tone control data subgroup.

11. The method according to claim 10, wherein setting the first parameter sets a timbre and setting the second parameter sets a rhythm.

12. The method according to claim 10, wherein the selected musical tone control data includes a tone volume, a brilliance, a tempo and a reverberation value.

13. The method according to claim 10, wherein setting the first parameter sets the timbre of an upper keyboard.

14. A method of selecting panel setting information data for an electronic musical instrument, the method comprising the steps of:

storing a plurality of panel setting information groups in which each group contains a plurality of panel setting information subgroups;

identifying each panel setting information group by a pair of parameters including a first parameter and a second parameter;

setting the first and second parameters;

reading out one of the stored plurality of panel setting information groups on the basis of the set first and second parameters;

storing the read out one of the stored panel setting information groups;

selecting one of the plurality panel setting information subgroups that is included in the stored and read out panel setting information group;

indicating a setting state for each of a plurality of manually operable members on the basis of the selected panel setting information subgroup; and controlling a musical tone in response to the setting states of the plurality of manually operable members indicated by the one panel setting information subgroup.

15. The method according to claim 14, wherein setting the first parameter sets a tone color and the second parameter sets a rhythm.

16. The method according to claim 14, wherein the panel setting information subgroup indicates the setting states of a tone volume, a brilliance, a tempo and a reverberation value for the plurality manually operable members.

17. The method according to claim 14, further including the step of storing a status of the plurality of manually operable members.

18. The method according to claim 14, further including activating a pedal, so that every time the pedal is operated, each of the plurality of panel setting information subgroups included in the stored and read out panel setting information group are selected in turn.

* * * * *